US008180273B2

(12) United States Patent
Fujihara

(10) Patent No.: US 8,180,273 B2
(45) Date of Patent: May 15, 2012

(54) MEANDERING DETECTION DEVICE, MEANDERING DETECTION METHOD, MEANDERING CORRECTION DEVICE, AND IMAGE FORMING APPARATUS

(75) Inventor: Kensuke Fujihara, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 717 days.

(21) Appl. No.: 11/984,107

(22) Filed: Nov. 13, 2007

(65) Prior Publication Data

US 2008/0112714 A1 May 15, 2008

(30) Foreign Application Priority Data

Nov. 14, 2006 (JP) ..... 2006-307897

(51) Int. Cl.
*G03G 15/00* (2006.01)

(52) U.S. Cl. .... 399/395; 399/162; 399/165; 250/559.36

(58) Field of Classification Search ..... 399/395, 399/301, 162, 165; 250/559.36, 556.37
See application file for complete search history.

(56) References Cited

U.S. PATENT DOCUMENTS 5,347,348 A * 9/1994 Nagata ..... 399/329
5,519,230 A * 5/1996 Hubble et al. ..... 250/559.36
7,668,491 B2 * 2/2010 Furuya et al. ..... 399/302

FOREIGN PATENT DOCUMENTS

JP 04063389 A * 2/1992
JP 8-106237 4/1996

* cited by examiner

*Primary Examiner* — Matthew G Marini
(74) *Attorney, Agent, or Firm* — Smith, Gambrell & Russell, LLP

(57) ABSTRACT

A meandering detection device capable of detecting meandering of a subject with high accuracy includes: a contact which has an open end making contact with and following a subject body and which is supported by a support part; a reflection part integrally provided to the contact and reflecting light; an emission part emitting light toward the reflection part; and a first and a second light receiving parts which are disposed in front of the reflection part, which receive the light reflected by the reflection part and then outputs signals in accordance with respective amounts of light received, and which detect meandering of the subject based on a difference in the amount of light received.

11 Claims, 5 Drawing Sheets

MEANDERING DETECTION DEVICE, MEANDERING DETECTION METHOD, MEANDERING CORRECTION DEVICE, AND IMAGE FORMING APPARATUS

This application is based on Japanese Patent Application No. 2006-307897 filed on Nov. 14, 2006, the contents of which are hereby incorporated by reference.

BACKGROUND OF THE INVENTION

1. Field of the Invention

The present invention relates to a meandering detection device and a meandering detection method for detecting meandering of a subject. The present invention also relates to a meandering correction device including the meandering detection device for detecting meandering of a subject. The present invention further relates to an image forming apparatus including the meandering detection device for detecting meandering of a revolving endless belt.

2. Description of Related Arts

An image forming apparatus including a conventional meandering detection device is disclosed in JP-A-H8-106237. This meandering detection device detects meandering of an endless belt that conveys a recording sheet of an image forming apparatus that is formed of a color copier, to transfer an image. The meandering detection device has a lever-type, turnable pivoted contact, one open end of which abuts a side surface of the endless belt in revolving movement. The meandering detection device also has a light emitting element and a light receiving element arranged to face each other. At the other end of the contact, a shutter is provided which partitions the light emitting element and the light receiving element therebetween by turning.

Meandering of the endless belt causes the contact to turn, whereby the light emitting element is covered by the shutter. In accordance with the amount of meandering of the endless belt, the amount of light received by the light receiving element varies. Thus, the amount of meandering can be detected based on an output of the light receiving element. Accordingly, the travel of the endless belt can be so adjusted to correct the meandering, thereby preventing color shift of a plurality of colors.

However, the amount of light emitted by a light emitting device such as an LED varies depending on the ambient temperature. Thus, with the conventional meandering detection device described above, even when the endless belt is not meandering, an increase in the ambient temperature decreases the amount of light received by the light receiving element, thus resulting in erroneous detection that meandering is occurring. This poses a problem of color shift occurring in the image forming apparatus.

SUMMARY OF THE INVENTION

In view of the problem described above, the present invention has been made, and it is an object of the present invention to provide a meandering detection device, a meandering detection method, and a meandering correction device capable of detecting meandering of a subject with high accuracy. It is another object of the present invention to provide an image forming apparatus capable of preventing color shift.

To address the first object described above, a meandering detection device in accordance with a first aspect includes: a contact having an open end making contact with and following a subject, the contact being supported by a support part; a reflection part integrally provided to the contact and reflecting light; an emission part emitting light toward the reflection part; and a first and a second light receiving parts disposed in front of the reflection part and receiving the light reflected by the reflection part, the first and second light receiving parts, in order to detect meandering of the subject, outputting signals in accordance with respective amounts of light received at the first and second light receiving parts.

According to this configuration, the contact abuts the subject making rotational movement or linear movement, and the light emitted from the emission part and reflected by the reflection part is received by the first and second light receiving parts. When the subject is disposed at a predetermined position, the amounts of light received at the first and second light receiving parts agree with each other. Meandering of the subject moves the contact, resulting in a difference in the amount of light received by the first and second light receiving parts. This permits detecting the meandering of the subject. The contact may be tilted or moved while being turnably pivoted or slidably supported, or may be tilted by elastic deformation with one end thereof fixed. Moreover, meandering in the direction along the moving surface with the contact brought into contact with the side surface of the subject may be detected, or meandering in the direction perpendicular to the moving surface with the contact brought into contact with the surface of the subject may be detected.

The meandering detection device in accordance with a second aspect of the present invention, in the meandering detection device in accordance with the first aspect, with the contact pivoted by the support part and with the reflection part and the open end arranged on sides opposite to each other with respect to the support part, meandering is detected by a change in a tilt angle of the contact.

The meandering detection device in accordance with a third aspect of the present invention, in the meandering detection device in accordance with the first aspect, stores a shape of the subject making revolving movement, and corrects the outputs of the first and second light receiving parts in accordance with an amount of displacement of the contact which is judged by the shape.

The meandering detection device in accordance with a fourth aspect of the present invention, in the meandering detection device in accordance with the third aspect, has the subject provided with either of a convex and a concave parts making contact with the contact.

To address the first object described above, a meandering detection method according to a fifth aspect of the present invention includes the steps of: causing an open end of a contact supported by a support part to make contact with and follow a subject; emitting light toward a light reflection part integrally provided to the contact; receiving light reflected by the reflection part with a first and a second light receiving parts disposed in front of the reflection part; and detecting meandering of the subject based on a difference between a first and a second signals respectively output by the first and second light receiving parts in accordance with respective amounts of light received.

To address the first object described above, a meandering correction device in accordance with a sixth aspect of the present invention includes: a meandering detection device including: a contact which has an open end making contact with and following a subject and which is supported by a support part; a reflection part integrally provided to the contact and reflecting light; an emission part emitting light toward the reflection part; and a first and a second light receiving parts which are disposed in front of the reflection part, which receive the light reflected by the reflection part, and which, in order to detect meandering of the subject, output signals in accordance with respective amounts of light received at the first and second light receiving parts, and a meandering correction part correcting meandering of the subject.

To achieve the second object described above, an image forming apparatus according to a seventh aspect of the present invention includes: a plurality of photoconductive drums; a revolving endless belt sequentially transferring, thereon or on a recording sheet conveyed thereby, toner images formed on the respective photoconductive drums; a meandering detection device including: a contact which has an open end making contact with and following the endless belt and which is supported by a support part, a reflection part integrally provided to the contact and reflecting light, an emission part emitting light toward the reflection part, and a first and a second light receiving parts which are disposed in front of the reflection part, which receive the light reflected by the reflection part, and which, in order to detect meandering of a subject, output signals in accordance with respective amounts of light received at the first and second light receiving parts.

According to this configuration, onto an intermediate transfer body formed of an endless belt making revolving movement and a recording sheet conveyed to the endless belt, the visualized toner images of different colors, such as yellow, magenta, cyan, and black, are sequentially transferred. The contact of the meandering detection device abuts the endless belt. The emission part of the meandering detection device emits light, and the light reflected by the reflection part is received by the first and second light receiving parts. When the endless belt is disposed at a predetermined position, the amounts of light received at the first and second light receiving parts agree with each other. Meandering of the endless belt moves the contact, resulting in a difference in the amounts of light received between the first and second light receiving parts. Therefore, the meandering of the endless belt is detected by detecting a difference or ratio in the amount of light received between the first and second light receiving parts. The contact may be tilted while being movably or turnably supported, may be tilted by elastic deformation with one end thereof fixed.

Consequently, even when the amount of light from the emission part varies depending on the ambient temperature, meandering of the subject can be detected with high accuracy based on a difference in the amount of light received between the first and second light receiving parts. Moreover, the contact of the meandering detection device is brought into contact with the side surface of the endless belt, which permits detecting meandering of the endless belt with high accuracy, thereby preventing color shift from occurring in the image forming apparatus.

The image forming apparatus according to an eighth aspect of the present invention, in the image forming apparatus according to the seventh aspect, with the contact pivot the support part and with the reflection part and the open end arranged on sides opposite to each other with respect to the support part, the meandering detection device detects meandering based on a change in a tilt angle of the contact. According to this configuration, the contact, with its open end in contact with the endless belt, turns around the support part, and the light reflected by the reflection part arranged on the side opposite to the open end with respect to the support part is received by the first and second light receiving parts.

Consequently, the emission part and the first and second light receiving parts can be easily installed apart from the endless belt. Moreover, toner adhesion to the emission part and the first and second light receiving parts can be reduced, thereby preventing deterioration in the detection accuracy.

The image forming apparatus according to a ninth aspect of the present invention, in the image forming apparatus according to the seventh aspect, stores a shape of a side surface of the endless belt making revolving movement, and corrects the outputs of the first and second light receiving parts in accordance with an amount of displacement of the contact which is judged by the shape.

According to this configuration, the shape of the side surface of the endless belt is previously stored in storage means. The contact repeatedly traces the side surface of the revolving endless belt and tilts in accordance with the shape of the side surface. The degree of tilt of the contact by the shape can be obtained by recognizing the position of the endless belt with another sensor or the like. Consequently, from the outputs of the first and second light receiving parts, the degree of tilt of the contact by the shape is corrected to thereby draw the amount of meandering, thus permitting prevention of erroneous meandering detection.

The image forming apparatus according to a tenth aspect of the present invention, in the image forming apparatus according to the ninth aspect, the subject of the meandering detection device is provided with either of a convex and a concave parts making contact with the contact. According to this configuration, the tilt angle of the contact making contact with either of the convex part and the concave part greatly changes, thus permitting detection of the position of the endless belt. Therefore, the position of the revolving endless belt in the revolving direction can be easily recognized. At this point, the outputs of the first and second light receiving parts that have greatly changed are ignored for meandering detection.

The image forming apparatus according to an eleventh aspect of the present invention, in the image forming apparatus according to the seventh aspect, based on a result of the detection by the meandering detection device, corrects a position of the endless belt in a direction perpendicular to a moving direction thereof. According to this configuration, upon detection of meandering of the endless belt by the meandering detection device, the running position of the endless belt is corrected in such a direction as to cancel the meandering of the endless belt, thus permitting easily providing an image forming apparatus without color shift.

DETAILED DESCRIPTION OF THE PREFERRED EMBODIMENTS

Hereinafter the embodiments of the present invention will be described with reference to the accompanying drawings.

Figure 1:
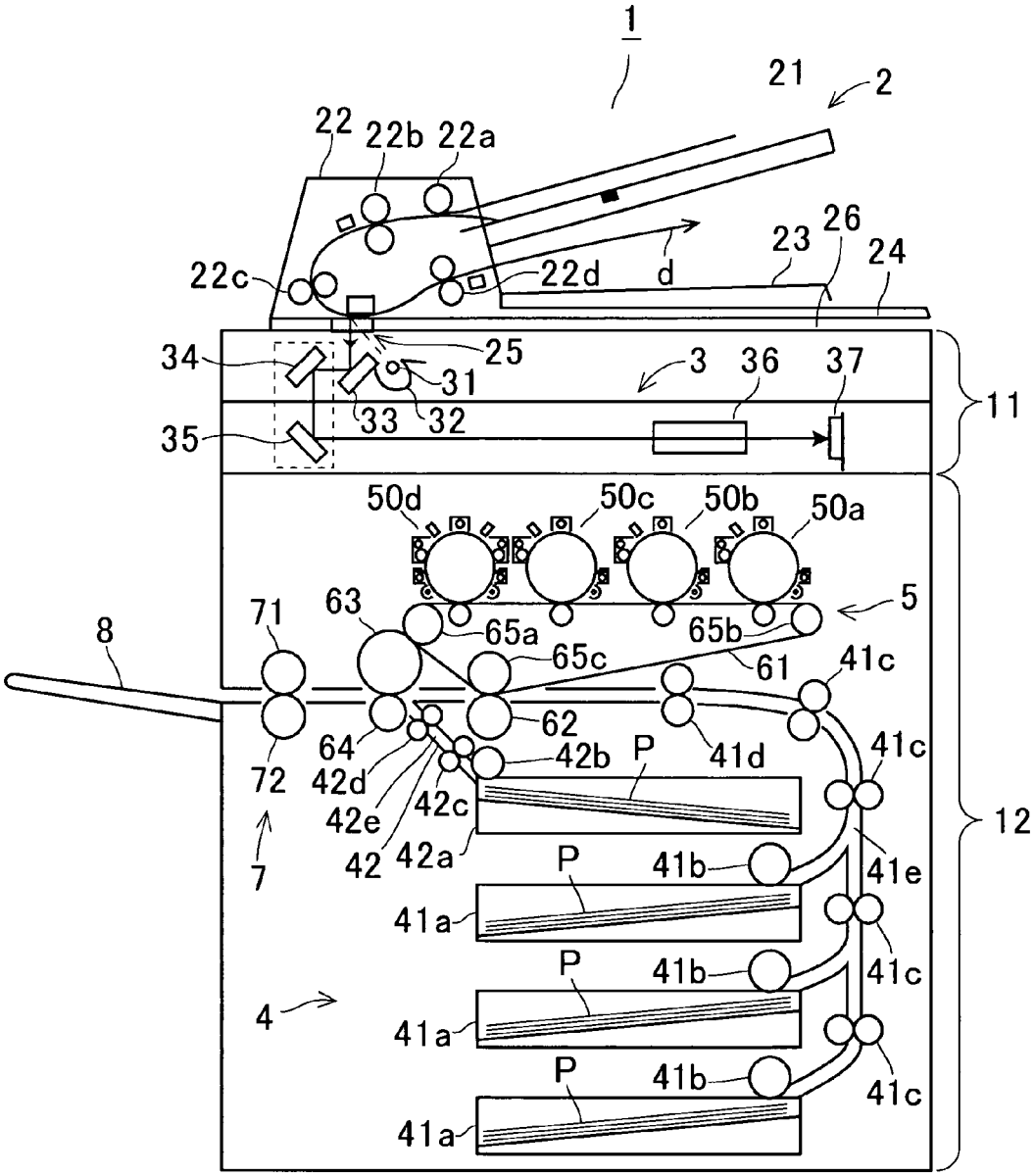
FIG. 1 is an elevation view to show a schematic configuration of an image forming apparatus according to a first embodiment of the present invention.

FIG. 1 is an elevation view to show a configuration of an image forming apparatus according to a first embodiment. The image forming apparatus 1 is a color copier, and has an upper housing 11 and a lower housing 12. On the upper housing 11, a document conveyance part 2 for conveying a document is mounted in such a manner as to be capable of opening and closing with a support provided at the rear part thereof.

The document conveyance part 2 includes: a document feed tray 21, a document conveyance part main body 22, a document discharge tray 23, and a document cover 24. On the document feed tray 21, a document is loaded. The document conveyance part main body 22 conveys the document fed from the document feed tray 21 for scanning. The document discharge tray 23 stores the document discharged from the document conveyance part main body 22. The document cover 24 opens the document conveyance part 2 and holds the document loaded on a document loading plate 26 provided on the top surface of the upper housing 11.

Provided inside the document conveyance part main body 22 are: in an order from an upstream side in a document conveyance direction d, a pickup roller 22*a*, conveyance rollers 22*b*, 22*c*, and 22*d*. The document is taken out from the document feed tray 21 by the pickup roller 22*a* and conveyed by the conveyance rollers 22*b*, 22*c*, and 22*d*.

Between the conveyance rollers 22*c* and 22*d*, an image scanning part 25 is provided. The image scanning part 25 holds, in a certain posture, the document fed from the 21, during which image scanning is performed by an exposure part 3 provided in the upper housing 11.

The exposure part 3 includes: an exposing lamp 31; a reflection plate 32; a first, a second, and a third mirrors 33, 34, and 35; a condensing lens 36; and an image sensor 37. The exposing lamp 31 emits light, which is condensed by the reflection plate 32 and then irradiated to the image scanning part 25. Light reflected on the document in the image scanning part 25 passes through the first to third mirrors 33 to 35 and then is condensed via the condensing lens 36 onto the image sensor 37 which is formed of, for example, a CCD or the like. As a result, an image on the document fed from the document feed tray 21 is scanned.

The exposing lamp 31, the reflection plate 32, and the first mirror 33 integrally move rightward as viewed in the figure to scan the document loaded on the document loading plate 26. As a result, light reflected on the document on the document loading plate 26 is condensed onto the image sensor 37 whereby the image on the document is scanned.

Provided inside the lower housing 12 are: a paper feed part 4, an image formation part 5, and a fixing device 7. To the outside of the lower housing 12, a paper discharge tray 8 is fitted. The paper feed part 4 is arranged at the bottom of the lower housing 12 and has a paper feed cassette 42*a* and a plurality of paper feed cassettes 41*a* all of which store recording sheets P.

The recording sheet P in the paper feed cassette 41*a* is conveyed through a recording sheet conveyance path 41*e*. A recording sheet conveyance path 42*e* diverges from the recording sheet conveyance path 41*e* and is coupled to the paper feed cassette 42*a*. The recording sheet P on the paper feed cassette 42*a*, after conveyed through the recording sheet conveyance path 42*e*, is conveyed through the recording sheet conveyance path 41*e*. The recording sheet P conveyed through the recording sheet conveyance path 41*e* is guided to the paper discharge tray 8 from a discharge end of the recording sheet conveyance path 41*e*.

The recording sheet conveyance path 41*e* diverges in correspondence with the different paper feed cassettes 41*a*, and each recording sheet conveyance paths 41*e* is provided with a pickup roller 41*b* and a conveyance roller 41*c*. On the merged recording sheet conveyance path 41*e*, a conveyance roller 41*d* is provided. The recording paper conveyance path 42*e* is provided with a pickup roller 42*b* and conveyance rollers 42*c* and 42*d*.

The recording sheets P is taken out from each of the paper feed cassettes 41*a* by the pickup roller 41*b* and conveyed by the conveyance rollers 41*c* and 41*d*. In addition, the recording sheet P is taken out from the paper feed cassette 42*a* by the pickup roller 42*b* and conveyed by the conveyance rollers 42*c* and 42*d*.

The image formation part 5 is disposed above the recording sheet conveyance path 41*e*. The image formation part 5 forms toner images of four colors including yellow, magenta, cyan, and black by superimposing them on one another on the recording sheet P conveyed through the recording paper conveyance path 41*e* or paper conveyance path 42*e*. In this embodiment, four toner images are transferred onto the recording sheet, but the same configuration is applicable to a case where two or more colors are used. The fixing device 7 is disposed at a subsequent stage of the image formation part 5. The fixing device 7 fixes, with heat, toner images formed on the recording sheet P by the image formation part 5.

Figure 2:
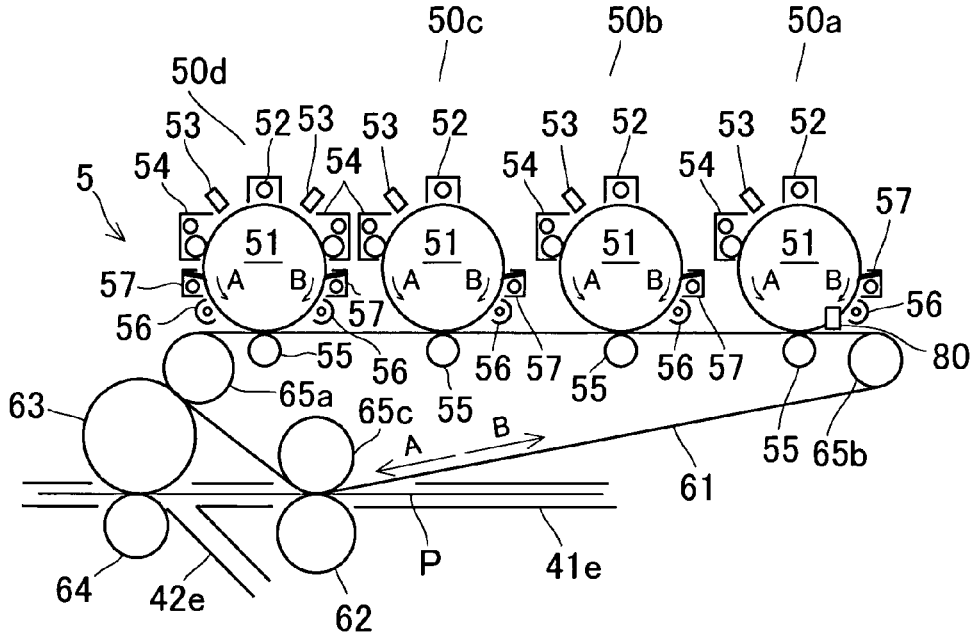
FIG. 2 is an elevation view to show details of an image formation part of the image forming apparatus according to the first embodiment of the present invention.

FIG. 2 is an elevation view to show details of the image formation part 5. The image formation part 5 includes: image forming units 50*a* to 50*d*; intermediate transfer bodies 61 and 63; transfer units 55, 62, and 64; and a meandering detection device 80. The intermediate transfer body 61 is formed of an endless belt, and revolves while being spread over and supported by support rollers 65*a*, 65*b*, and 65*c* in a form of an inequilateral triangle. The meandering detection device 80, as will be described in detail later, detects meandering of the intermediate transfer body 61. The intermediate transfer body 63 is formed of a rotary drum, and so arranged to face the support roller 65*a* with the intermediate transfer body 61 therebetween.

A plurality of transfer units 55 are provided in such a manner as to face respective photoconductive drums 51 which will be described later with the intermediate transfer body 61 therebetween. To the transfer units 55, voltage of a polarity which is opposite to the polarity of a toner charged on the surface of the photoconductive drum 51, is applied. The transfer unit 62 is so arranged as to face the support roller 65*c* with the recording sheet P passing through the recording sheet conveyance path 41*e* and the intermediate transfer body 61 therebetween. To the transfer unit 62, voltage of a polarity which is opposite to the polarity of a toner charged on the surface of the intermediate transfer body 61 is applied.

The transfer unit 64 is provided at a subsequent stage of a diverging point of the recording paper conveyance paths 41*e* and 42*e*, and so arranged as to face the intermediate transfer body 63 with the recording sheet P passing through the recording paper conveyance path 41*e* therebetween. To the transfer unit 64, voltage of a polarity which is opposite to the polarity of a toner charged on the surface of the intermediate transfer body 63 is applied. Although not illustrated, near the intermediate transfer body 63, a transfer unit is provided to which voltage of a polarity which is opposite to the polarity of the toner charged on the surface of the intermediate transfer body 61 is applied.

The image forming units 50*a* to 50*d* have the same configuration and are in tandem arrangement in contact with the intermediate transfer body 61. By the image forming units 50*a* to 50*d*, yellow, magenta, cyan, and black toner images are formed respectively. The black image forming unit 50*d* is arranged in a side closer to the intermediate transfer body 63.

The order of layout in which the yellow, magenta, and cyan image forming units 50*a* to 50*c* are arrayed may be changed.

The image forming units 50*a* to 50*d* each has the photoconductive drum 51. The image forming units 50*a* to 50*c* each has: a charger 52, an optical scanning unit 53, a developing unit 54, a static eliminator 56, and a cleaning unit cleaning unit 57, which are arranged counterclockwise around the photoconductive drum 51 as viewed in the figure. Between the developing unit 54 and the static eliminator 56, the photoconductive drum 51 makes contact with the intermediate transfer body 61.

The photoconductive drum 51 rotates counterclockwise (in a direction of arrow A) as viewed in the figure, whereby the charger 52 uniformly charges the photoconductive drum 51. The optical scanning unit 53 emits laser light to erase charges on the surface of the charged photoconductive drum 51 in accordance with image information scanned by the image sensor 37 (see FIG. 1). As a result, an electrostatic latent image is formed on the surface of the photoconductive drum 51.

The developing unit 54 supplies a toner to the electrostatic latent image formed on the photoconductive drum 51 to thereby visualize the latent image as the toner image. This toner image is transferred onto the intermediate transfer body 61 by the transfer unit 55. The static eliminator 56 removes the charges on the surface of the photoconductive drum 51. The cleaning unit 57 is formed of a blade and the like that makes contact with the photoconductive drum 51, and removes the residual toner which is not transferred onto the intermediate transfer body 61.

The black image forming unit 50*d*, as is the case with the image forming units 50*a* to 50*c*, is provided with: in order counterclockwise from the top as viewed in the figure, a charger 52, an optical scanning unit 53, and a developing unit 54. The black image forming unit 50*d* is also provided with a static eliminator 56 and a cleaning unit 57 sandwiching a contact portion with the intermediate transfer body 61 therebetween. As a result, the photoconductive drum 51 rotates counterclockwise (in the direction of arrow A) as viewed in the figure, which permits a toner image to be transferred onto the intermediate transfer body 61.

Also provided clockwise from the charger 52 as viewed in the figure are an optical scanning unit 53 and a developing unit 54. A static eliminator 56 and a cleaning unit 57 are also provided which sandwich a contact portion with the intermediate transfer body 61 therebetween. As a result, the photoconductive drum 51 rotates clockwise (in the direction of arrow B) as viewed in the figure, which permits a toner image to be transferred onto the intermediate transfer body 61.

In the image forming apparatus 1 with the configuration described above, when a document is set on the document feed tray 21 or the document loading plate 26, an image formed on the document is scanned by the image sensor 37 of the exposure part 3. The image information scanned is then transmitted to the image formation part 5.

If a color image is formed in the image formation part 5, by driving of the support roller 65*b*, the intermediate transfer body 61 is rotated in the direction of arrow A in FIG. 2. In addition, the photoconductive drum 51 of each of the image forming units 50*a* to 50*d* rotates clockwise (in the direction of arrow A) as viewed in the figure. Upon start of the rotation of the photoconductive drum 51, the chargers 52 uniformly charge the surface of the photoconductive drum 51.

Next, charges corresponding to an image portion formed on the recording sheet P or a non-image portion are erased by laser light emitted from the optical scanning unit 53, thereby an electrostatic latent image is formed on the photoconductive drum 51. The electrostatic latent image on the photoconductive drum 51 is supplied with a toner from the developing unit 54 and then visualized as a toner image.

When the photoconductive drum 51 further rotates and the toner image faces the transfer unit 55, voltage of a polarity which is opposite to the polarity of the charges of the toner is applied to the transfer unit 55. This causes the toner image formed on the surface of the photoconductive drum 51 to be transferred onto the intermediate transfer body 61. The electrostatic latent image formed on the photoconductive drum 51 is diselectrified by the static eliminator 56 and the residual toner which is not transferred is removed from the photoconductive drum 51 by the cleaning unit 57.

The image forming units 50*a* to 50*d* are sequentially driven at predetermined timing, and the toner images including the black toner image are superimposed on one another on the intermediate transfer body 61.

The intermediate transfer body 61 further rotates, and the toner images are disposed at a position facing the transfer unit 62. At this point, the recording sheet P conveyed through the recording paper conveyance path 41*e* is disposed between the intermediate transfer body 61 and the transfer unit 62. Voltage of a polarity which is opposite to the polarity of charges of the toner is applied to the transfer unit 62, whereby the toner images formed on the intermediate transfer body 61 are transferred onto the recording sheet P. The residual toner which is not transferred but remaining on the intermediate transfer body 61 is removed from the intermediate transfer body 61 by a cleaning unit (not shown).

The recording sheet P with the toner images transferred thereon is conveyed through the recording paper conveyance path 41*e* and guided to the fixing device 7. In the fixing device 7, the toner images are fixed onto the recording sheet P. The recording sheet P with the images fixed thereon is conveyed through the recording paper conveyance path 41*e* and then discharged to the paper discharge tray 8.

To form a monochrome image with the image formation part 5, driving of the support roller 65*a* causes the intermediate transfer body 61 to rotate in the direction of arrow B in FIG. 2. The photoconductive drums 51 of the yellow, magenta, and cyan image forming units 50*a* to 50*c*, in contact with the intermediate transfer body 61, rotate in the direction of arrow B, but does not perform image formation.

In the black image forming unit 50*d*, the photoconductive drum 51 rotates clockwise (in the direction of arrow B) as viewed in the figure. Then, as described above, a monochrome toner image is formed onto the photoconductive drum 51 and then transferred onto the intermediate transfer body 61. The toner image transferred onto the intermediate transfer body 61 faces the intermediate transfer body 63, upon which the toner image is transferred onto the intermediate transfer body 63 by a transfer unit, not shown.

The intermediate transfer body 63 further rotates, and the toner image transferred onto the intermediate transfer body 63 is disposed at a position facing the transfer unit 64. At this point, the recording sheet P conveyed through the recording paper conveyance paths 42*e* and 41*e* from the paper feed cassette 42*a* is disposed between the intermediate transfer body 63 and the transfer unit 64. Voltage of a polarity which is opposite to the polarity of charges of the toner is applied to the transfer unit 64, whereby the toner image formed on the intermediate transfer body 63 is transferred onto the recording sheet P. The residual toner which is not transferred but remaining on the intermediate transfer body 63 is removed from the intermediate transfer body 63 by a cleaning unit (not shown).

The recording sheet P with the toner image transferred thereon is conveyed through the recording paper conveyance path 41*e* and guided to the fixing device 7. In the fixing device 7, the toner image is fixed onto the recording sheet P. The recording sheet P with the image fixed thereon is conveyed through the recording paper conveyance path 41*e* and then discharged to the paper discharge tray 8.

Consequently, in a case where a monochrome image is formed, as compared to a case where a color image is formed, the distance in which the toner image moves from the photoconductive drum 51 until when it is fixed onto the recording sheet P becomes shortened. Therefore, the time until a first image is discharged in the monochrome image formation can be reduced.

Figure 3:
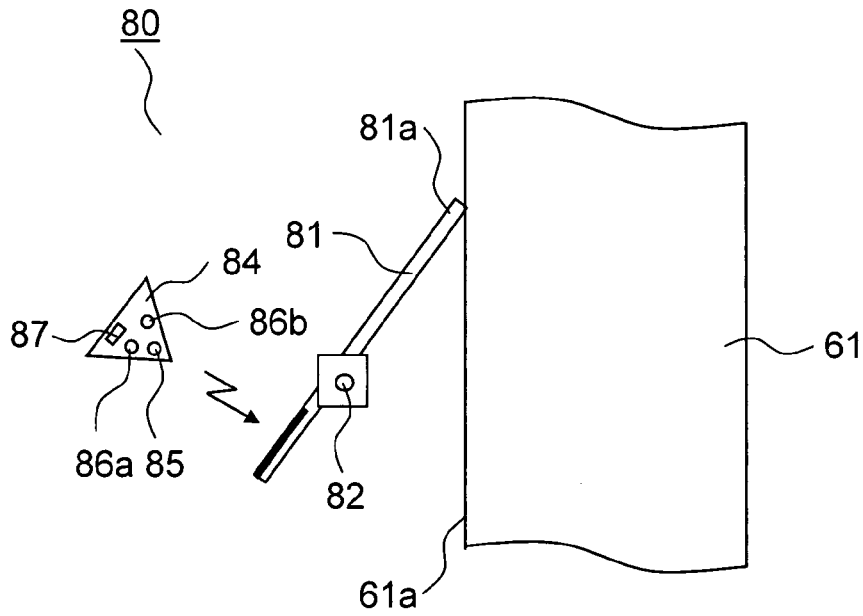
FIG. 3 is a plan view to show a meandering detection device of the image forming apparatus according to the first embodiment of the present invention.

FIG. 3 is a plan view to show a configuration of the meandering detection device 80. The meandering detection device 80 has a lever-type contact 81 which makes contact at one open end 81*a* thereof with a side surface 61*a* of the intermediate transfer body 61 and which is turnably supported by a support part 82. As a result, meandering of the intermediate transfer body 61 formed of a revolving endless belt within the moving surface changes the tilt angle of the contact 81.

At an end opposite to the open end 81*a* with respect to the support part 82, a reflection part 83 formed of a mirror or the like that reflects light is provided. At a position opposing the reflection part 83, a tilt sensor 84 is disposed. The tilt sensor 84 has an emission part 85 and a pair of first and second light receiving parts 86*a* and 86*b*.

The emission part 85 is formed of an LED or the like and emits substantially parallel light having a prescribed width toward the reflection part 83. The first and second light receiving parts 86*a* and 86*b* are each formed of a photodiode, or the like and respectively disposed on the both sides of the emission part 85. The first and second light receiving parts 86*a* and 86*b* receive light emitted from the emission part 85 and reflected by the reflection part 83, perform photoelectric conversion on this light, and then output signals in accordance with the respective amounts of light received. Moreover, in the tilt sensor 84, a control circuit 87 is provided which is fed with signals from the first and second light receiving parts 86*a* and 86*b* and then outputs certain processing results.

Parallel arrangement of the reflection part 83 with the direction in which the first and second light receiving parts 86*a* and 86*b* are disposed achieves agreement in the amount of light received between the first and second light receiving parts 86*a* and 86*b*. Tilting of the contact 81 from this state results in an increase in the amount of light received at one of the first and second light receiving parts 86*a* and 86*b* and a decrease in the amount of light received at the other one of the first and second light receiving parts 86*a* and 86*b*. This therefore creates an output difference between the first and second light receiving parts 86*a* and 86*b*.

Figure 4:
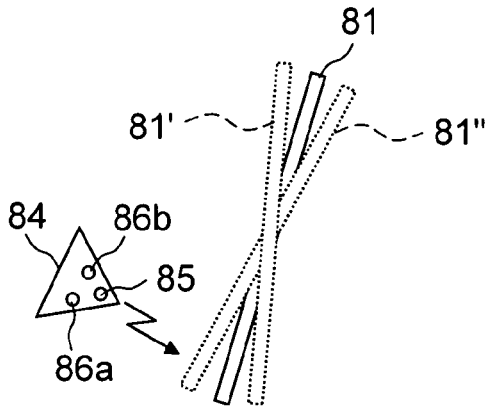
FIG. 4 is a plan view to show operation of the meandering detection device of the image forming apparatus according to the first embodiment of the present invention.
Figure 5:
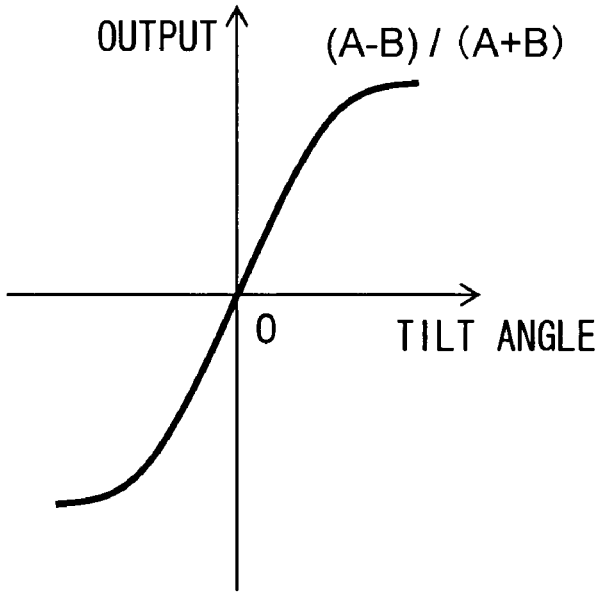
FIG. 5 is a diagram to show an output of a tilt sensor of the image forming apparatus according to the first embodiment of the present invention.

Specifically, as shown in FIG. 4, the tilting of the contact 81 from a state indicated by a solid line to a state indicated by a broken line 81' increases the amount of light received at the first light receiving part 86*a* and decreases the amount of light received at the second light receiving part 86*b*. The tilting of the contact 81 to a state indicated by a broken line 81" increases the amount of light received at the second light receiving part 86*b* and decreases the amount of light received at the first light receiving part 86*a*.

Where an output of the first light receiving part 86*a* is A and an output of the second light receiving part 86*b* is B, the control circuit 87 is made to output a calculation result, C=(A−B)/(A+B). Therefore, the output C of the control circuit 87 for the tilt angle of the contact 81 becomes the diagram as shown in FIG. 5. In this figure, the vertical axis denotes the output C=(A−B)/(A+B), and the horizontal axis denotes the tilt angle of the contact 81.

According to this figure, when the tilt angle of the contact 81 is near 0°, the output C substantially proportional to the tilt angle is provided. Accordingly, the tilt angle of the contact 81 can be obtained from the output C of the control circuit 87, thus permitting detection of meandering of the intermediate transfer body 61.

At this point, the control circuit 87 outputs the calculation result based on an output difference between outputs A and B of the first and second light receiving parts 86*a* and 86*b*. Alternatively, the control circuit 87 may output a calculation result based on a ratio between the outputs A and B. That is, the control circuit 87 may output a calculation result based on a difference in the amount of light received between the first and second light receiving parts 86*a* and 86*b*. Still alternatively, the control circuit 87 may be omitted, and the output signals of the first and second light receiving parts 86*a* 86*b* may be input, for calculation, to a control part (not shown) that controls operation of the image forming apparatus 1.

Upon detection of meandering of the intermediate transfer body 61, its position in the direction (that is, direction of meandering) perpendicular to the direction of revolving movement is corrected so as to cancel the meandering. The correction of the position of the intermediate transfer body 61 is achieved, based on a result of detection by the meandering detection device 80, by a meandering correction part (not shown) that corrects meandering displacement of the intermediate transfer body 61. The meandering correction part is composed of: for example, a pressing part for pressing the intermediate transfer body 61 in the direction perpendicular to the direction of revolving movement; a tilt change part for changing tilt of the support rollers 65*a*, 65*b*, and 65*c*; and so on. This consequently reduces color shift in the axial direction of the photoconductive drum 51 occurring upon superimposing toner images of a plurality of colors on one another on the intermediate transfer body 61.

In the monochrome image formation, the driving of the tilt sensor 84 is stopped to achieve power saving. Moreover, in the monochrome image formation, the open end 81*a* of the contact 81 may be separated from the intermediate transfer body 61. This permits reducing abrasion of the side surface 61*a* of the intermediate transfer body 61 and of the contact 81, thus maintaining favorable detection accuracy for a long time.

According to this embodiment, the meandering detection device 80 has the contact 81 that makes contact with the intermediate transfer body 61 formed of an endless belt, and receives, at the first and second light receiving parts 86*a* and 86*b*, light emitted from the emission part 85 and reflected by the reflection part 83 provided at the contact 81, and then detects meandering of the intermediate transfer body 61 based on a difference in the amount of light received between the first and second light receiving parts 86*a* and 86*b*. Thus, even if the amount of light from the emission part 85 varies depending on the ambient temperature, the meandering of the intermediate transfer body 61 can be detected with high accuracy based on a difference in the amount of light received between the first and second light receiving parts 86*a* and 86*b*, thus permitting prevention of color shift in the image forming apparatus 1.

Though the contact 81 is turnably supported by the support part 82, alternatively, the contact 81 may be formed in a cantilever shaped, with one end thereof fixed. As a result, the contact 81 is elastically deformed and then tilted by the meandering of the intermediate transfer body 61. In this condition, the reflection part 83 can be provided between the open end

81*a* and the support part, so that the tilt of the contact 81 can be detected with light reflected by the reflection part 83. Moreover, the contact 81 may be so formed as to be slidable substantially perpendicularly to the end of the subject and so held as to be movable in parallel. The parallel movement of the contact 81 changes the area of the reflection part opposing the first and second light receiving parts 86*a* and 86*b*, thereby changing the respective amounts of light received, which permits meandering detection.

However, it is more preferable, as described in the present embodiment above, that the contact 81 be pivoted by the support part 82 and that the reflection part 83 and the open end 81*a* be arranged on sides opposite to each other with respect to the support part 82. Accordingly, the tilt sensor 84 can be separated from the intermediate transfer body 61, thus permitting easy installation of the tilt sensor 84. Moreover, toner adhesion to the emission part 85 and the first and second light receiving parts 86*a* and 86*b* can be reduced, which permits preventing a deterioration in the detection accuracy.

Figure 6:
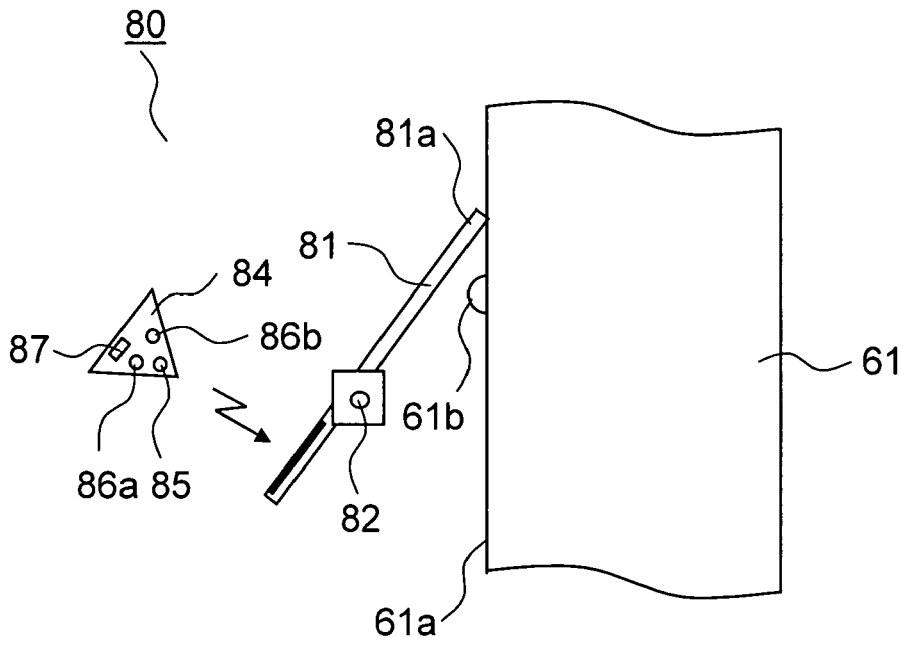
FIG. 6 is a plan view to show a meandering detection device portion of an image forming apparatus according to a second embodiment of the present invention.

Next, FIG. 6 is a plan view to show a configuration of a meandering detection device 80 portion of an image forming apparatus 1 according to a second embodiment of the present invention. For illustrative purposes, those portion equivalent to those in the first embodiment shown in FIGS. 1 to 3 are provided with the same numerals. In this embodiment, a convex part 61*b* is provided at one area of the side surface 61*a* of the intermediate transfer body 61. Other portions are identical to those in the first embodiment.

The shape of the side surface 61*a* of the intermediate transfer body 61 is previously stored in a storage part (now shown) provided in a control part (not shown) of the image forming apparatus 1. The meandering detection device 80, upon contact between the contact 81 and the convex part 61*b*, is greatly tilted. The control part of the image forming apparatus 1, when an absolute value of an output C of a control circuit 37 exceeds a predetermined value, judges that the contact 81 has made contact with the convex part 61*b*. This permits determining the position of the intermediate transfer body 61 in the revolving direction.

Excessively great tilt of the contact 81 by the convex part 61*b* can lead to judgment that the contact 81 has made contact with the convex part 61*b* when the detection range of the transfer unit 64 is exceeded. Instead of the convex part 61*b*, a concave part can be provided on the side surface 61*a* of the intermediate transfer body 61 to detect the position of the intermediate transfer body 61. Moreover, the position of the revolving intermediate transfer body 61 in the revolving direction may be detected by a sensor separately provided.

Based on the position of the intermediate transfer body 61 and the shape of the side surface 61*a* of the intermediate transfer body 61 stored in the storage part, the degree of tilt of the contact 81 by the shape in a non-meandering state can be obtained. As a result, from the output of the control circuit 37 based on the amounts of light received at the first and second light receiving parts 86*a* and 86*b*, correction of subtracting the tilt of the contact 81 by the shape is performed at the control part. Therefore, erroneous meandering detection due to unevenness of the side surface 61*a* of the intermediate transfer body 61 can be prevented.

The second embodiment can provide the same effect as is provided by the first embodiment and also can prevent erroneous detection of meandering of the intermediate transfer body 61.

In the first and second embodiments, a toner image formed on the photoconductive drum 51 is transferred onto the intermediate transfer body 61 formed of an endless belt. Alternatively, the image forming apparatus may transfer a toner image directly from the photoconductive drum 51 onto the recording sheet P conveyed by the endless belt. In this condition, meandering of the endless belt conveying the recording sheet P can be detected by the meandering detection device 80. This permits, as described above, reducing color shift when toner images of a plurality of colors are superimposed on one another.

The image forming apparatus 1 is formed of a color copier, but may be of a different type, such as a printer, a facsimile device, or the like. That is, in the image forming apparatus forming a color image by transferring toner images of a plurality of colors from the photoconductive drum 51, the same effect can be provided.

Moreover, the meandering detection device 80 can detect not only meandering of the endless belt provided in the image forming apparatus 1 but also meandering of other subjects. That is, the meandering detection device 80 can detect, with high accuracy, meandering within the moving surface and meandering perpendicular to the moving surface of a subject, such as a revolving endless belt making linear movement or a circular plate making rotational movement.

Further, the meandering of the subject may also be corrected by a meandering correction device having the meandering detection device 80 and a meandering correction part. That is, the meandering correction part is composed of: a pressing part for pressing the subject, a tilt change part for changing the tilt of a roller revolving and driving the subject body; and so on. The meandering correction part corrects the meandering of the subject based on a result of detection by the meandering detection device 80.

The present invention can provide a meandering detection device and a meandering detection method for detecting meandering of a subject. The invention also can provide a meandering correction device including a meandering detection device for detecting meandering of a subject. Further, the present invention can provide an image forming apparatus including a meandering detection device for detecting meandering of a revolving endless belt.

What is claimed is:

1. A meandering detection device for contacting a subject and following the subject to detect meandering thereof, said device comprising:

a tilt sensor disposed in a plane and including an emission part that emits light, and light receiving parts, the light receiving parts including a first light receiving part and a second light receiving part that define a first axis therebetween in said plane; and a contact device including a contact part, and a support part pivotably supporting the contact part, the contact part including a contact end part that contacts the subject, and a reflection part integral with the contact end part, the contact part defining on the reflection part a second axis parallel to the first axis so long as the subject does not meander such that the emission part emits light to the reflection part and the reflection part reflects a first amount of reflected light to the first light receiving device and a second amount, which is equal to the first amount, of reflected light to the second light receiving device to cause each light receiving device to generate an output indicative of the amount of reflected light received thereby, whereby meandering of the subject moves the contact end part and thereby tilts the second axis of the contact part out of parallel alignment with the first axis of the light receiving parts such that each light receiving part receives an amount of reflected light different from the first and second amounts and changes its output accordingly.

2. The meandering detection device according to claim 1, wherein a shape of the subject followed is stored, and the outputs of the first and second light receiving parts are corrected in accordance with an amount of displacement of the contact part which is judged based on the shape.

3. The meandering detection device according to claim 2, wherein the subject is provided with either of a convex part and a concave part making contact with the contact part.

4. The meandering detection device according to claim 1, wherein a control device determines meandering of the endless belt according to a function of (A−B)/(A+B), where "A" is the output of the first light receiving part, and "B" is the output of the second light receiving part.

5. A meandering detection method comprising the steps of:

causing a contact end part of a contact part supported by a support part to make contact and follow a subject;

emitting light toward a light reflection part integrally provided to the contact part;

receiving reflected light reflected by the reflection part with each of first and second light receiving parts disposed in front of the reflection part, the first light receiving part receiving a first amount of reflected light and the second light receiving part receiving a second amount of reflected light;

outputting a first signal and a second signal from the first and second light receiving parts in accordance with respective amounts of reflected light received by each of the light receiving parts; and determining if there is meandering of the subject based on a difference between the first signal and the second signal, wherein the first and second light receiving parts define a first axis, the contact device defines, on the reflection part, a second axis parallel to the first axis so long as the subject does not meander, and meandering of the subject pivots the contact part and thereby tilts the second axis of the contact part out of parallel alignment with the first axis of the first and second light receiving parts, such that each light receiving part receives an amount of reflected light different from the first and second amounts of reflected light and changes its output signal accordingly.

6. A meandering correction device comprising:

a meandering detection device for contacting a subject and following the subject to detect meandering thereof, said device including:

a tilt sensor disposed in a plane and including an emission part that emits light, and light receiving parts, the light receiving parts including a first light receiving part and a second light receiving part that define a first axis therebetween in said plane, and a contact device including a contact part, and a support part pivotably supporting the contact part, the contact part including a contact end part that contacts the subject, and a reflection part integral with the contact end part, the contact part defining, on the reflection part, a second axis parallel to the first axis so long as the subject does not meander such that the emission part emits light to the reflection part and the reflection part reflects a first amount of reflected light to the first light receiving device and a second amount, which is equal to the first amount, of reflected light to the second light receiving device to cause each light receiving device to generate an output indicative of the amount of reflected light received thereby, whereby meandering of the subject moves the contact end part and thereby tilts the second axis of the contact part out of parallel alignment with the first axis of the light receiving parts such that each light receiving part receives an amount of reflected light different from the first and second amounts and changes its output accordingly; and a meandering correction part correcting meandering of the subject based on a result of detection by the meandering detection device.

7. An image forming apparatus comprising:

a plurality of photoconductive drums;

a revolving endless belt sequentially transferring, thereon or on a recording sheet conveyed thereby, toner images formed on the respective photoconductive drums; and a meandering detection device that contacts the endless belt and follows the belt to detect meandering thereof, said device including:

a tilt sensor disposed in a plane and including an emission part that emits light, and light receiving parts, the light receiving parts including a first light receiving part and a second light receiving part that define a first axis therebetween in said plane, and a contact device including a contact part, and a support part pivotably supporting the contact part, the contact part including a contact end part that contacts the subject, and a reflection part integral with the contact end part, the contact part defining, on the reflection part, a second axis parallel to the first axis so long as the subject does not meander such that the emission part emits light to the reflection part and the reflection part reflects a first amount of reflected light to the first light receiving device and a second amount, which is equal to the first amount, of reflected light to the second light receiving device to cause each light receiving device to generate an output indicative of the amount of reflected light received thereby; and a control part that determines, from the output of each of the light receiving parts, whether meandering of the endless belt moves the contact end part and thereby tilts the second axis of the contact part out of parallel alignment with the first axis of the light receiving parts to cause the light receiving parts to change their outputs corresponding to a change in reflected light that each light receiving part receives.

8. The image forming apparatus according to claim 7, wherein the meandering detection device stores a shape of a side surface of the endless belt, and corrects the outputs of the first and second light receiving parts in accordance with an amount of displacement of the contact part which is judged based on the shape.

9. The image forming apparatus according to claim 8, wherein the endless belt is provided with either of a convex part and a concave part making contact with the contact part.

10. The image forming apparatus according to claim 7, wherein, based on a result of the detection by the meandering detection device, a position of the endless belt in a direction perpendicular to a moving direction thereof is corrected.

11. The image forming apparatus according to claim 7, wherein the control part determines meandering of the endless belt according to a function of (A−B)/(A+B), where "A" is the output of the first light receiving part, and "B" is the output of the second light receiving part.

* * * * *